US005726376A

United States Patent [19]

Menges et al.

[11] Patent Number: 5,726,376

[45] Date of Patent: Mar. 10, 1998

[54] BREECHBLOCK SYSTEM FOR A GUN

[75] Inventors: Horst Menges, Ratingen; Lothar Post, Fassberg; Erich Bender, Rottweil; Rainer Buhl, Dornhan; Helmut Mäder, Schramberg, all of Germany

[73] Assignee: Rheinmetall Industrie AG, Ratingen, Germany

[21] Appl. No.: 721,097

[22] Filed: Sep. 27, 1996

[30] Foreign Application Priority Data

Sep. 30, 1995 [DE] Germany ..... 195 36 660.3

[51] Int. Cl.[6] ..... F41A 17/64

[52] U.S. Cl. ..... 89/190; 89/176; 42/70.08

[58] Field of Search ..... 42/70.08, 75.01; 89/173, 175, 180, 187.01, 187.02, 189, 149, 150, 183, 190, 176

[56] References Cited

U.S. PATENT DOCUMENTS

| | | | |
|---|---|---|---|
| 851,538 | 4/1907 | Luger | 42/75.01 |
| 1,262,169 | 4/1918 | Buckham | 89/175 |
| 2,089,671 | 8/1937 | Stecke | 89/183 |
| 2,135,005 | 11/1938 | Hoaglang et al. | 89/149 |
| 2,651,974 | 9/1953 | Simpson | 89/187.01 |
| 2,948,195 | 8/1960 | Linder | 89/187.02 X |
| 3,473,434 | 10/1969 | Brieger | 89/187.01 X |
| 4,194,433 | 3/1980 | Zellweger et al. | 89/190 |
| 4,240,325 | 12/1980 | Hürlemann | 89/190 |
| 4,506,589 | 3/1985 | Junker et al. | 89/190 |
| 4,730,537 | 3/1988 | Matzagg et al. | 42/70.08 X |
| 5,259,137 | 11/1993 | Blenk et al. | 89/180 X |
| 5,458,046 | 10/1995 | Blenk et al. | 89/190 |

FOREIGN PATENT DOCUMENTS

| | | | |
|---|---|---|---|
| 42 07 252 | 9/1993 | Germany | 89/187.01 |

*Primary Examiner*—Michael J. Carone
*Assistant Examiner*—Matthew J. Lattig
*Attorney, Agent, or Firm*—Spencer & Frank

[57] ABSTRACT

A breechblock system for a gun includes a breechblock; a firing pin slidably received in the breechblock and having two diametrically oppositely located catch recesses; and two locking levers pivotally supported by the breechblock on opposite sides thereof and each having first and second arms. The two locking levers have a locking position and an unlocking position. In the locking position the first arm of the respective locking levers projects into the respective catch recesses for preventing the firing pin from moving from its locked position into its firing position. Further, two bolts are provided which are movably supported on opposite sides of the breechblock and which cooperate with the breechblock and with respective locking levers. The bolts have a withdrawn position and an advanced position. In the withdrawn position the bolts are out of a depressing engagement with the respective locking levers, whereby the locking levers are maintained in the locking position by a force-exerting arrangement. In the advanced position the bolts depress the respective locking levers, whereby the locking levers are maintained in the unlocking position in which the second arms of the respective locking levers are spaced from the catch recesses.

5 Claims, 2 Drawing Sheets

BREECHBLOCK SYSTEM FOR A GUN

CROSS REFERENCE TO RELATED APPLICATION

This application claims the priority of German Application No. 195 36 660.3 filed Sep. 30, 1995, which is incorporated herein by reference.

BACKGROUND OF THE INVENTION

This invention relates to a breechblock system for a gun and is of the type that has a breechblock and two bolts disposed on opposite sides of the breechblock and movable towards and away therefrom in a radial direction relative to the breechblock axis. The breechblock receives a firing pin which is longitudinally displaceable between locked and firing positions. Further, the breechblock system includes two pivotal, two-arm locking levers. A first arm of each locking lever is engageable by a respective bolt in such a manner that upon locking of the breechblock, the first arm of each locking lever is pivoted towards the firing pin, while, at the same time, the second arm of each locking lever is pivoted away from the firing pin. As a result of such an occurrence, the firing pin is free to move into the firing position.

A breechblock system of the above-outlined type is disclosed in German Offenlegungsschrift (application published without examination) No. 42 07 252. The breechblock system disclosed therein has two bolts situated on opposite sides of the breechblock, supporting the breechblock on each side. To prevent a firing of a cartridge in case of defective bolting on one or both sides of the breechblock, in addition to the firing pin which is longitudinally displaceably received in the breechblock, an auxiliary firing pin is provided to which an ignition stroke may be imparted. The auxiliary firing pin is separated from the firing pin by a clearance whose width is variable by two spacer members. The firing pin is, with the intermediary of each spacer member, shiftable through a partial stroke of a predetermined full stroke from a locked position (initial position) into its igniting position by means of locking levers arranged laterally of the breechblock.

It is a principal disadvantage of the known breechblock system of the above-outlined type that it is of relatively complex construction.

SUMMARY OF THE INVENTION

It is an object of the invention to provide an improved breechblock system of the above-outlined type which is of simple construction and in which an ignition of the propellant is securely prevented in case the breechblock is not safely locked on one or both sides.

This object and others to become apparent as the specification progresses, are accomplished by the invention, according to which, briefly stated, the breechblock system includes a breechblock; a firing pin slidably received in the breechblock and having two diametrically oppositely located catch recesses; and two locking levers pivotally supported by the breechblock on opposite sides thereof and each having first and second arms. The two locking levers have a locking position and an unlocking position. In the locking position the first arm of the respective locking levers projects into the respective catch recesses for preventing the firing pin from moving from its locked position into its firing position. Further, two bolts are provided which are movably supported on opposite sides of the breechblock and which cooperate with the breechblock and with respective locking levers. The bolts have a withdrawn position and an advanced position. In the withdrawn position the bolts are out of a depressing engagement with the respective locking levers, whereby the locking levers are maintained in the locking position by a force-exerting arrangement. In the advanced position the bolts depress the respective locking levers, whereby the locking levers are maintained in the unlocking position in which the second arms of the respective locking levers are spaced from the catch recesses.

In essence, the invention is based on the principle to provide the firing pin with recesses which constitute two catching edges and into which projects the second end of each locking lever in the locked position of the firing pin. The unlocking of the firing pin is effected by pivoting the respective first end of the locking levers towards the firing pin during bolting (locking) action of the breechblock, whereby the respective second end of each locking lever pivots out of the associated catching recess of the firing pin.

According to a further advantageous feature of the invention, the firing pin is pushed back into its initial position from the firing position by a resetting pin which form-lockingly engages the firing pin and whose motion is controlled by an external drive. A breechblock system according to the invention has been found to be particularly advantageous for use in externally driven automatic weapons for which an external drive—moving most of the functional components participating in the firing cycle—is present in any event.

DESCRIPTION OF THE PREFERRED EMBODIMENT

Figure 1:
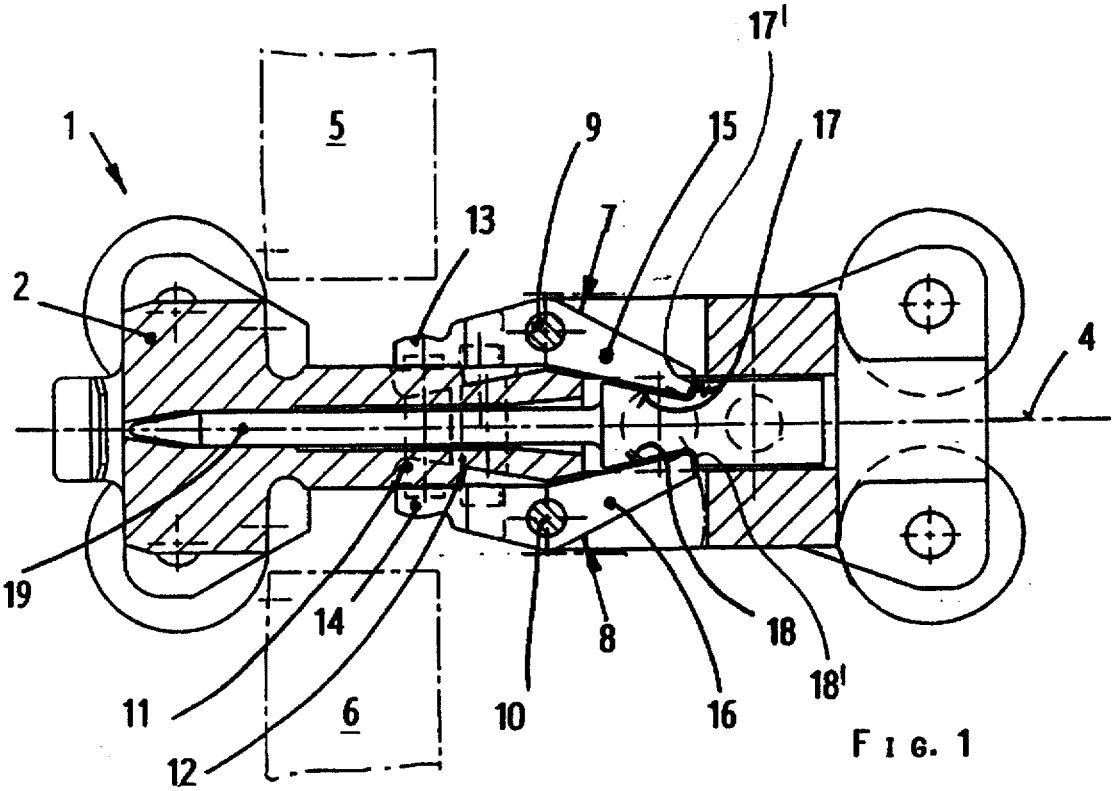
FIG. 1 is a longitudinal sectional view of a preferred embodiment of the breechblock system according to the invention, showing the breechblock in an unbolted state and the firing pin in a locked state (starting position).
Figure 2:
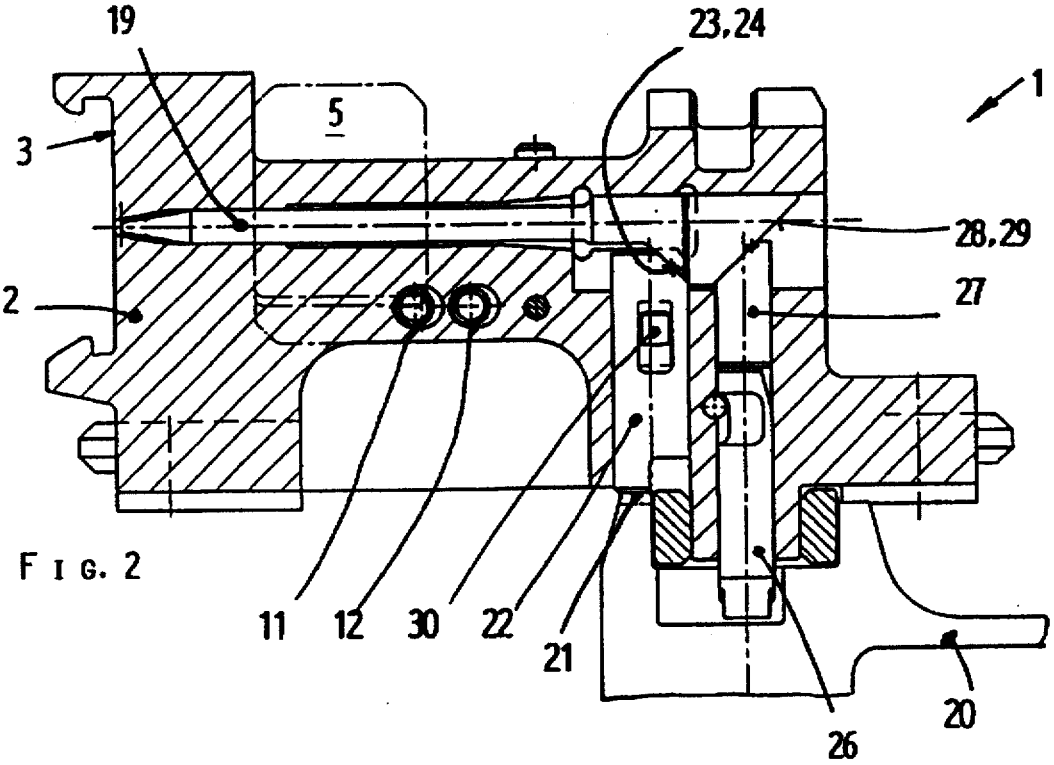
FIG. 2 is an axial sectional view of the structure shown in FIG. 1, taken along a plane perpendicular to the sectional plane of FIG. 1.

FIGS. 1 and 2 illustrate a breechblock system for an externally driven automatic gun. The breechblock system includes a breechblock 2 having a frontal end 3 to which the weapon barrel (not shown for the sake of clarity) may be secured. The breechblock 2 is mounted on a non-illustrated weapon housing in which, perpendicularly to the longitudinal axis 4 of the breechblock 2, two oppositely located bolts 5 and 6 (shown in phantom lines in FIG. 1) are slidably supported for displacement towards and away from the breechblock 2.

On each side of the breechblock 2, two two-arm locking levers 7 and 8 are arranged which are pivotal about a respective pivot bearing 9 and 10 supported in the breechblock 2 and extending perpendicularly to the longitudinal axis 4 of the breechblock 2. The two locking levers 7, 8 are biased radially by respective compression springs 11 and 12 supported in the breechblock 2. Each locking lever 7, 8 has a respective first arm 13, 14 urged radially outwardly by the associated spring 11, 12 and engageable by an adjacent respective bolt 5 and 6. Each locking lever 7, 8 further has a respective second arm 15 and 16 which, in the pivotal position shown in FIG. 1, extends into a respective catch recess 17 and 18 of a firing pin 19. The catch recesses are bordered by respective catching shoulders 17' and 18'. The firing pin 19 is slidable between locked and firing positions.

For displacing the firing pin 19 from its firing position into its locked position, a resetting pin 22 is provided which may be connected to an external drive 20 by means of a cam 21 and which, on its side oriented towards the firing pin 19, is provided with a cam face 23 engaging a cam face 24 of the firing pin 19.

Figure 4:
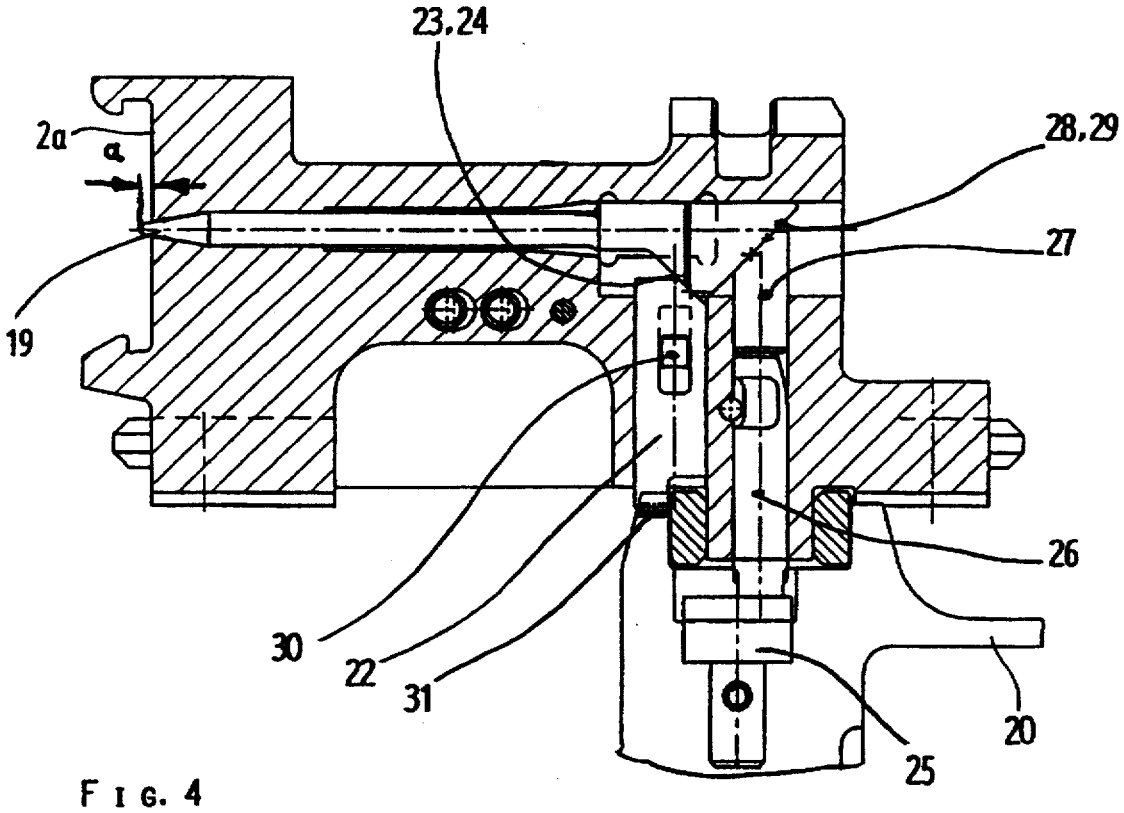
FIG. 4 is an axial sectional view of the structure shown in FIG. 3, taken along a plane perpendicular to the sectional plane of FIG. 3.

Further, as shown in FIG. 4, the firing pin 19 is connected with the external drive 20 by means of a control component 25 secured to the drive 20, a control plunger 26 and a camming plunger 27. The camming plunger 27 has a cam face 28 which is adapted to exert a force on a cam face 29 provided on the firing pin 19.

In the description which follows, the operation of the above-described breechblock system will be set forth.

In the initial position shown in FIGS. 1 and 2, the compression springs 11 and 12 press the first arms 13 and 14 of the respective locking levers 7 and 8 radially outwardly so that the respective second arms 15 and 16 of the locking levers 7 and 8 project into the catch recesses 17 and 18 of the firing pin 19. Thus, by virtue of the blocking cooperation between the arm 15 and the catching shoulder 17', as well as between the arm 16 and the catching shoulder 18', no accidental firing of a cartridge may occur. Further, in the initial position, the resetting pin 22 likewise blocks a displacement of the firing pin 19 toward the firing position by virtue of the cooperation between the cam faces 23 and 24. The resetting pin 22 is held by a holding member 30 in its initial, blocking position. The holding member 30 may be guided in a non-illustrated rail.

As the two bolts 5 and 6 are moved radially inwardly towards the axis 4 for locking the breechblock 2, they depress the first arms 13 and 14 of the locking levers 7, 8, whereby the second arms 15 and 16 move out of the catch recesses 17 and 18, thus unlocking the firing pin 19. At the same time, the holding member 30 is moved into a withdrawn position by a component 31 of the external drive 20, allowing the resetting pin 22 to be displaced. In this state the weapon is ready for firing.

Figure 3:
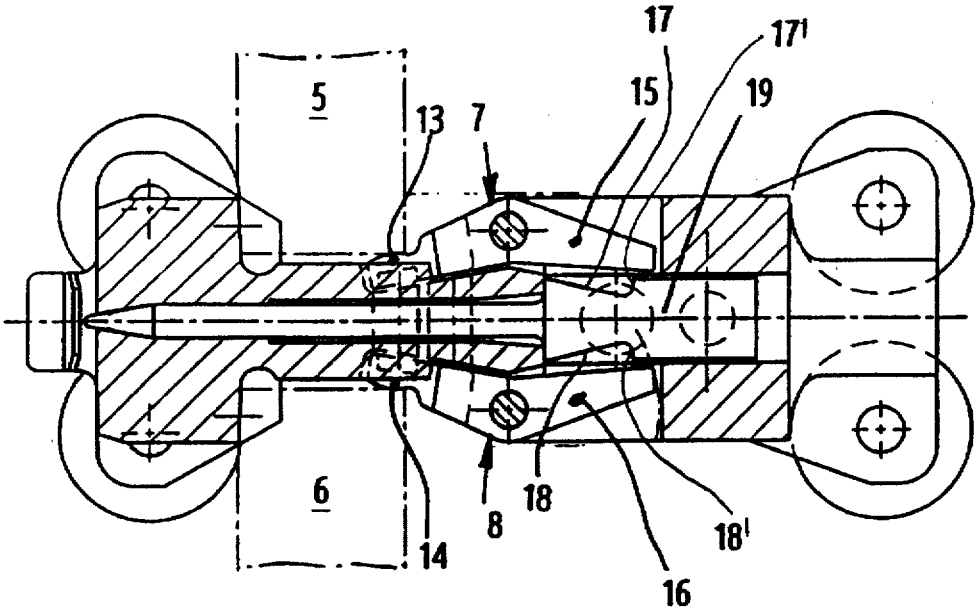
FIG. 3 is a view similar to FIG. 1, illustrating the breechblock in a bolted position and the firing pin in a firing position.

To perform the firing operation, the firing pin 19 is, by means of the control component 25, the control plunger 26 and the camming plunger 27 accelerated in a forward direction into the firing position as illustrated in FIGS. 3 and 4. The tip of the firing pin 19 moves by a defined distance a beyond the breechblock surface 2*a* and fires the cartridge situated in the barrel chamber.

After firing, the cam 21 of the external drive 20 pushes the resetting pin 22 radially toward the breechblock axis 4, whereby the firing pin 19 is shifted into its initial position depicted in FIGS. 1 and 2 by virtue of the cooperation between camming faces 23 and 24.

It will be understood that the above description of the present invention is susceptible to various modifications, changes and adaptations, and the same are intended to be comprehended within the meaning and range of equivalents of the appended claims.

What is claimed is:

1. A breechblock system for a gun, comprising (a) a breechblock;

(b) a firing pin slidably received in said breechblock; said firing pin having a locked position and a firing position; said firing pin further including means for defining two diametrically oppositely located catch recesses;

(c) two locking levers pivotally supported by said breechblock on opposite sides thereof; each locking lever having a locking position and an unlocking position; each locking lever further including first and second arms; in said locking position said first arm of the respective locking levers projecting into respective said catch recesses for preventing said firing pin from moving from said locked position into said firing position;

(d) force-exerting means for urging said locking levers into said locking position;

(e) two bolts movably supported on opposite sides of said breechblock and cooperating with said breechblock and said respective locking levers; said bolts having a withdrawn position and an advanced position; in said withdrawn position said bolts being out of depressing engagement with said respective locking levers, whereby said locking levers are maintained in said locking position by said force-exerting means; in said withdrawn position said bolts being out of bolting engagement with said breechblock; in said advanced position said bolts being in a depressing engagement with said respective locking levers while overcoming a force of said force-exerting means, whereby said locking levers are maintained in said unlocking position in which said second arms are out of engagement with said catch recesses; in said advanced position said bolts being in a bolting engagement with said breechblock; and (f) a resetting pin movably received in said breechblock; said resetting pin having a first part connectable to an external drive and a second part cooperating with a part of said firing pin for displacing said firing pin from said firing position into said locked position.

2. The breechblock system as defined in claim 1, wherein said second part of said resetting pin includes a first cam face and said part of said firing pin includes a second cam face; said first and second cam faces being in engagement with one another.

3. The breechblock system as defined in claim 2, further comprising a holding member for immobilizing said resetting pin in said locked position of said firing pin, whereby said first cam face, by engagement with said second cam face, blocks movement of said firing pin from said locked position into said firing position.

4. A breechblock system for a gun, comprising (a) a breechblock;

(b) a firing pin slidably received in said breechblock; said firing pin having a locked position and a firing position; said firing pin further including means for defining two diametrically oppositely located catch recesses;

(c) two locking levers pivotally supported by said breechblock on opposite sides thereof; each locking lever having a locking position and an unlocking position; each locking lever further including first and second arms; in said locking position said first arm of the respective locking levers projecting into respective said catch recesses for preventing said firing pin from moving from said locked position into said firing position;

(d) force-exerting means for urging said locking levers into said locking position;

(e) two bolts movably supported on opposite sides of said breechblock and cooperating with said breechblock and said respective locking levers; said bolts having a withdrawn position and an advanced position; in said withdrawn position said bolts being out of depressing engagement with said respective locking levers, whereby said locking levers are maintained in said locking position by said force-exerting means; in said withdrawn position said bolts being out of bolting engagement with said breechblock; in said advanced position said bolts being in a depressing engagement with said respective locking levers while overcoming a force of said force-exerting means, whereby said locking levers are maintained in said unlocking position in which said second arms are out of engagement with said catch recesses; in said advanced position said bolts being in a bolting engagement with said breechblock; and (f) a camming plunger movably received in said breechblock and having a first cam face cooperating with a second cam face provided on said firing pin; said camming plunger being connectable to an external drive for moving said firing pin from said locked position into said firing position.

5. A breechblock system for a gun, comprising (a) a breechblock;

(b) a firing pin slidably received in said breechblock; said firing pin having a locked position and a firing position; said firing pin further including means for defining two diametrically oppositely located catch recesses;

(c) two locking levers pivotally supported by said breechblock on opposite sides thereof; each locking lever having a locking position and an unlocking position; each locking lever further including first and second arms; in said locking position said first arm of the respective locking levers projecting into respective said catch recesses for preventing said firing pin from moving from said locked position into said firing position;

(d) force-exerting means for urging said locking levers into said locking position; said force-exerting means including separate compression springs supported in said breechblock and engaging respective said locking levers; and (e) two bolts movably supported on opposite sides of said breechblock and cooperating with said breechblock and said respective locking levers; said bolts having a withdrawn position and an advanced position; in said withdrawn position said bolts being out of depressing engagement with said respective locking levers, whereby said locking levers are maintained in said locking position by said force-exerting means; in said withdrawn position said bolts being out of bolting engagement with said breechblock; in said advanced position said bolts being in a depressing engagement with said respective locking levers while overcoming a force of said force-exerting means, whereby said locking levers are maintained in said unlocking position in which said second arms are out of engagement with said catch recesses; in said advanced position said bolts being in a bolting engagement with said breechblock.

* * * * *